US009943108B2

(12) United States Patent
Lord

(10) Patent No.: US 9,943,108 B2
(45) Date of Patent: Apr. 17, 2018

(54) ELECTRONIC VAPOR PROVISION DEVICE

(71) Applicant: NICOVENTURES HOLDINGS LIMITED, London (GB)

(72) Inventor: Christopher Lord, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 0 days.

(21) Appl. No.: 14/415,552

(22) PCT Filed: Jul. 15, 2013

(86) PCT No.: PCT/EP2013/064952

§ 371 (c)(1),
(2) Date: Jan. 16, 2015

(87) PCT Pub. No.: WO2014/012906

PCT Pub. Date: Jan. 23, 2014

(65) Prior Publication Data

US 2015/0208728 A1 Jul. 30, 2015

(30) Foreign Application Priority Data

Jul. 16, 2012 (GB) ..... 1212606.6

(51) Int. Cl.
*A24F 47/00* (2006.01)
*A24F 7/00* (2006.01)

(52) U.S. Cl.
CPC ..... *A24F 47/008* (2013.01); *A24F 7/00* (2013.01)

(58) Field of Classification Search
CPC ..... A24F 47/008; A61L 9/037
USPC ..... 392/394
See application file for complete search history.

(56) References Cited

U.S. PATENT DOCUMENTS

| | | | | |
|---|---|---|---|---|
| 2,057,353 | A | 10/1936 | Whittemore | |
| 3,148,996 | A | 9/1964 | Vukasovich | |
| 4,827,950 | A | 5/1989 | Banerjee et al. | |
| 5,144,962 | A | 9/1992 | Counts et al. | |
| 6,280,793 | B1 | 8/2001 | Atwell | |
| 6,532,965 | B1 | 3/2003 | Abhulimen et al. | |
| 2003/0063902 | A1* | 4/2003 | Pedrotti | A61L 9/037 392/395 |
| 2004/0065749 | A1 | 4/2004 | Kotary | |
| 2006/0131439 | A1 | 6/2006 | Lakatos | |
| 2009/0288668 | A1 | 11/2009 | Inagaki | |
| 2009/0302019 | A1 | 12/2009 | Selenski | |
| 2010/0006113 | A1 | 1/2010 | Urtsev et al. | |

(Continued)

FOREIGN PATENT DOCUMENTS

| | | | |
|---|---|---|---|
| CN | 201054977 | Y | 5/2008 |
| CN | 201079011 | Y | 7/2008 |

(Continued)

OTHER PUBLICATIONS

CN101843368A Translation; Sep. 2010; Zhiping Chen.*

(Continued)

*Primary Examiner* — Eric Yarry
(74) *Attorney, Agent, or Firm* — Patterson Thuente Pederson, P.A.

(57) ABSTRACT

An electronic vapor provision device comprising a power cell, a vaporizer and a liquid store, wherein the vaporizer comprises a heater and a heater support, wherein the liquid store comprises a porous material.

25 Claims, 7 Drawing Sheets

(56) References Cited

U.S. PATENT DOCUMENTS

| | | | | |
|---|---|---|---|---|
| 2011/0094523 | A1* | 4/2011 | Thorens | A24F 47/008 131/194 |
| 2011/0126848 | A1* | 6/2011 | Zuber | A24F 47/008 131/329 |
| 2011/0155153 | A1* | 6/2011 | Thorens | H05B 3/58 131/329 |
| 2011/0209717 | A1* | 9/2011 | Han | A24F 47/008 131/273 |
| 2011/0303231 | A1 | 12/2011 | Li | |
| 2012/0111347 | A1 | 5/2012 | Hon | |
| 2012/0279512 | A1* | 11/2012 | Hon | A24F 47/008 131/329 |
| 2012/0285475 | A1 | 11/2012 | Liu | |
| 2013/0056013 | A1 | 3/2013 | Terry | |
| 2013/0192615 | A1* | 8/2013 | Tucker | H01C 17/00 131/328 |
| 2013/0192623 | A1 | 8/2013 | Tucker | |
| 2013/0298905 | A1 | 11/2013 | Levin | |
| 2014/0202454 | A1 | 7/2014 | Buchberger | |
| 2015/0157055 | A1 | 6/2015 | Lord | |
| 2015/0196058 | A1 | 7/2015 | Lord | |
| 2016/0106154 | A1 | 4/2016 | Lord | |
| 2016/0353804 | A1 | 12/2016 | Lord | |

FOREIGN PATENT DOCUMENTS

| | | | | | |
|---|---|---|---|---|---|
| CN | 201379072 | Y | | 1/2010 | |
| CN | 101843368 | A | * | 9/2010 | |
| CN | 103974369 | A | | 8/2014 | |
| DE | 29713866 | | | 11/1997 | |
| DE | 102006004484 | | | 8/2007 | |
| DE | 102007011120 | A1 | | 9/2008 | |
| EP | 1283062 | A1 | | 2/2003 | |
| EP | 1736065 | A1 | | 12/2006 | |
| EP | 2022349 | | | 2/2009 | |
| EP | 2113178 | A1 | | 11/2009 | |
| EP | 2404515 | A1 | | 1/2012 | |
| EP | 2444112 | A1 | | 4/2012 | |
| JP | 3392138 | | | 3/2003 | |
| JP | 2009-537119 | | | 10/2009 | |
| KR | 20-2011-0006928 | | | 7/2011 | |
| KR | 101081481 | B1 | * | 11/2011 | A24F 47/008 |
| WO | 2007078273 | A1 | | 7/2007 | |
| WO | WO2009022232 | | | 2/2009 | |
| WO | WO 2010/045671 | A1 | | 4/2010 | |
| WO | WO 2011/107737 | A1 | | 9/2011 | |
| WO | WO2011124033 | | | 10/2011 | |
| WO | WO 2011/106788 | A1 | | 12/2011 | |
| WO | WO 2011/160788 | | | 12/2011 | |
| WO | WO 2012/072762 | A1 | | 6/2012 | |
| WO | WO 2013/083631 | A1 | | 6/2013 | |
| WO | WO 2013/116571 | A1 | | 8/2013 | |

OTHER PUBLICATIONS

KR 101081481 Translation; Kim Hyung Yoon; Nov. 2011.*
International Search Report and Written Opinion, dated Oct. 11, 2013, for Application No. PCT/EP2013/064952, filed Jul. 15, 2013.
International Preliminary Report on Patentability, dated Oct. 27, 2014, for Application No. PCT/EP2013/064952, filed Jul. 15, 2013.
Application and File History for U.S. Appl. No. 14/415,540, filed Jan. 16, 2015, inventor Lord.
International Search Report and Written Opinion dated Dec. 2, 2013, for Application No. PCT/EP2013/064950 filed Jul. 15, 2013.
IPRP dated Oct. 31, 2014, for Application No. PCT/EP2013/064950 filed Jul. 15, 2013.
Japanese Office Action, Japanese Application No. 2015-522065, dated Jan. 5, 2016, 2 pages.
Canadian Office Action, Application No. 2,878,973, dated Jan. 22, 2016, 6 pages.
Canadian Office Action, Application No. 2,878,959, dated Jan. 18, 2016, 6 pages.
Japanese Office Action, Application No. 2015-522064, dated Dec. 28, 2015, 2 pages.
Korean Office Action, Application No. 10-2015-7001256, dated Sep. 7, 2016, 11 pages.
Korean Office Action, Application No. 10-2015-7001257, dated Sep. 8, 2016, 15 pages.
Chinese Office Action, Chinese Application No. 201380038055.5, dated Apr. 18, 2016, 9 pages.
Japanese Office Action for Japanese Application No. 2015-522066 dated Jan. 5, 2016. 2 pages.
Russian Decision to Grant for Russian Application No. 201500878 dated Sep. 9, 2016.
European Search Report for European Application No. 16189742 dated Mar. 17, 2017.
Chinese Office Action for Chinese Application No. 201380038055.5 dated Jul. 11, 2017, 3 pgs.
European Notice of Opposition for European Patent No. EP2871984 dated Jun. 5, 2017, 17 pgs.
Russian Decision to Grant from Russian Application No. 2015100881 dated Apr. 6, 2016.

* cited by examiner

ELECTRONIC VAPOR PROVISION DEVICE

CLAIM FOR PRIORITY

This application is the National Stage of International Application No. PCT/EP2013/064952, filed Jul. 15, 2013, which in turn claims priority to and benefit of United Kingdom Patent Application No. GB1212606.6, filed Jul. 16, 2012. The entire contents of the aforementioned applications are herein expressly incorporated by reference.

TECHNICAL FIELD

The specification relates to electronic vapour provision devices.

BACKGROUND

Electronic vapour provision devices are typically cigarette-sized and typically function by allowing a user to inhale a nicotine vapour from a liquid store by applying a suction force to a mouthpiece. Some electronic vapour provision devices have an airflow sensor that activates when a user applies the suction force and causes a heater coil to heat up and vaporise the liquid. Electronic vapour provision devices include electronic cigarettes.

SUMMARY

In an embodiment there is provided an electronic vapour provision device comprising a power cell, a vaporiser and a liquid store, where the vaporiser comprises a heating element and a heating element support, wherein the liquid store comprises a porous material. The heating element support may form part of the liquid store or may be the liquid store. Moreover, the heating element may be supported from its outside by the heating element support or the heating element may be supported from its inside by the heating element support.

One or more gaps may be provided between the heating element and the heating element support.

In another embodiment there is provided a vaporiser for use in the electronic vapour provision device, comprising a heating element and a porous heating element support, wherein the heating element support is a liquid store.

In another embodiment there is provided a mouthpiece, including a heating element and a porous heating element support, wherein the heating element support is a liquid store.

In another embodiment there is provided an electronic vapour provision device comprising a heating element for vaporising liquid; an air outlet for vaporised liquid from the heating element; and a porous heating element support, wherein the heating element support is a store of liquid. The electronic vapour provision device may include a power cell for powering the heating element.

BRIEF DESCRIPTION OF THE DRAWINGS

For a better understanding of the disclosure, and to show how example embodiments may be carried into effect, reference will now be made to the accompanying drawings in which.

DETAILED DESCRIPTION

Figure 1:
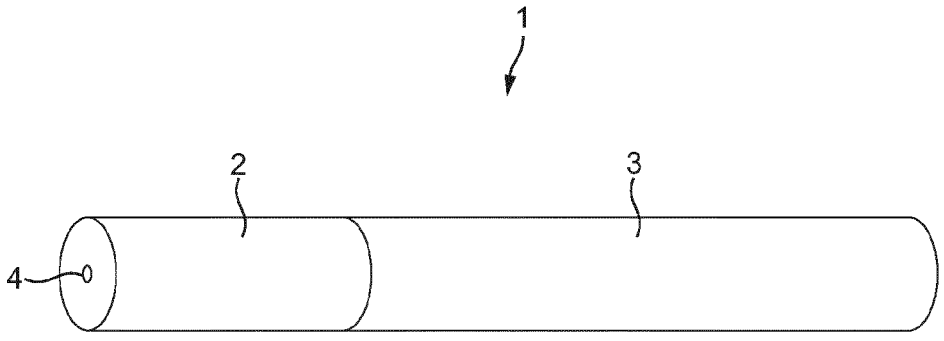
FIG. 1 is a side perspective view of an electronic cigarette.

In an embodiment there is provided an electronic vapour provision device comprising a power cell, a vaporiser and a liquid store, where the vaporiser comprises a heating element and a heating element support, wherein the liquid store comprises a porous material. The electronic vapour provision device may be an electronic cigarette. By having a liquid store comprising porous material, the liquid can be retained more efficiently, and also release and storage of the liquid is more controlled through the wicking action of the porous material.

The liquid store may comprise a solid porous material or a rigid porous material. For example, the liquid store may comprise a porous ceramic material. A solid porous material is advantageous since it is not open to deformation so the properties can be set and maintained. The shape can be defined at the manufacturing stage and this specific shape can be retained in the device to give consistency in device usage.

The liquid store may not comprise an outer liquid store container. Providing a solid porous material removes the need for an outer liquid store container and therefore gives a more efficient storage means.

The porous material may be optimized for liquid retention and wicking and/or for liquid glycerine retention and wicking. Moreover, the porous material may have pores of substantially equal size. The porous material may comprise pores distributed evenly throughout the material. Moreover, the porous material may be configured such that the majority of the material volume comprises open pores for liquid storage. The liquid store may be sealed on at least part of an outer surface region to inhibit porosity in that region.

The porous material may have smaller pores in a region next to the heating element and larger pores further from the heating element. The porous material may have a gradient of pore sizes ranging from smaller pores next to the heating element to larger pores further from the heating element.

The liquid store may be configured to wick liquid onto the heating element. The configuration of pores acts to determine the wicking effect of the storage medium, such that a more efficient means of transmission of liquid onto the heating element can be achieved.

The heating element support may form part of the liquid store, a separate additional liquid store or the entirety of the liquid store. By removing the requirement for a separate support, the number of components is reduced giving a simpler and cheaper device and enabling a larger liquid store to be used for increased capacity.

The heating element may be supported from its outside by the heating element support. Alternatively or additionally, the heating element may be supported from its inside by the heating element support.

One or more gaps may be provided between the heating element and the heating element support. Providing a gap between the heating element and the heating element support allows liquid to be gathered and stored in the gap region for vaporisation. The gap can also act to wick liquid onto the heating element. Also, providing a gap between the heating element and support means that a greater surface area of the heating element is exposed thereby giving a greater surface area for heating and vaporisation.

The heating element may be a heating coil, such as a wire coil. The heating coil may be coiled so as to be supported along its length by the heating element support. Moreover, the turns of the heating coil may be supported by the heating element support. For example, the turns of the heating coil may be in contact with the heating element support. One or more gaps may be provided between the heating coil and the heating element support. By providing a gap between a coil turn and the support, liquid can be wicked into the gap and held in the gap for vaporisation. In particular, liquid can be wicked by the spaces between coil turns and into the gap between a coil turn and the support.

The vaporiser may further comprise a vaporisation cavity such that, in use, the vaporisation cavity is a negative pressure cavity. At least part of the heating element may be inside the vaporisation cavity. By having the heating element in the vaporisation cavity, which in turn is a negative pressure cavity when a user inhales through the electronic cigarette, the liquid is directly vaporised and inhaled by the user.

The electronic vapour provision device may comprise a mouthpiece section and the vaporiser may form part of the mouthpiece section. Moreover, the liquid store may form part of the mouthpiece section. For example, the liquid store may substantially fill the mouthpiece section.

Referring to FIG. 1 there is shown an embodiment of the electronic vapour provision device 1 in the form of an electronic cigarette 1 comprising a mouthpiece 2 and a body 3. The electronic cigarette 1 is shaped like a conventional cigarette having a cylindrical shape. The mouthpiece 2 has an air outlet 4 and the electronic cigarette 1 is operated when a user places the mouthpiece 2 of the electronic cigarette 1 in their mouth and inhales, drawing air through the air outlet 4. Both the mouthpiece 2 and body 3 are cylindrical and are configured to connect to each other coaxially so as to form the conventional cigarette shape.

Figure 2:
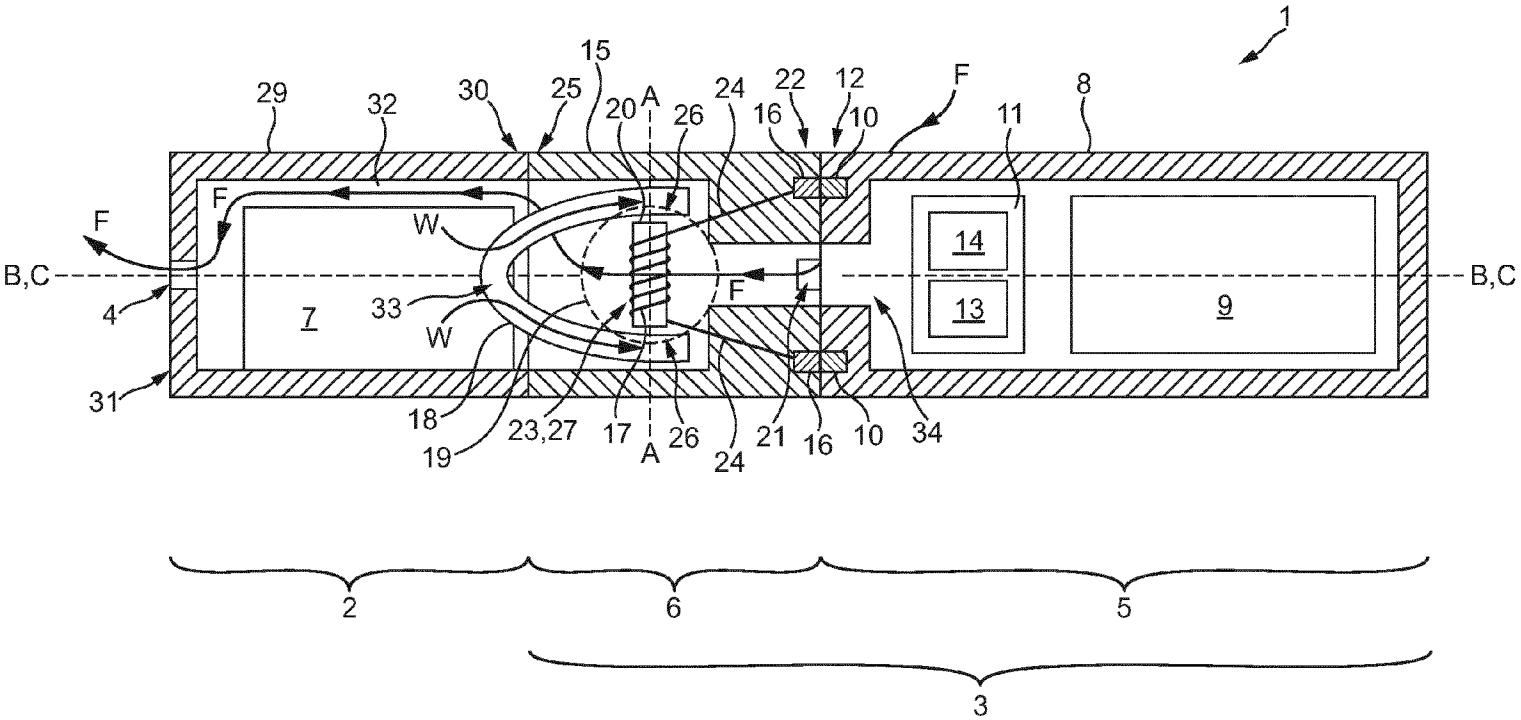
FIG. 2 is a schematic sectional view of an electronic cigarette having a perpendicular coil.

FIG. 2 shows an example of the electronic cigarette 1 of FIG. 1. The body 3 comprises two detachable parts, comprising a battery assembly 5 part and a vaporiser 6 part, and the mouthpiece 2 comprises a liquid store 7. The electronic cigarette 1 is shown in its assembled state, wherein the detachable parts 2, 5, 6 are connected in the following order: mouthpiece 2, vaporiser 6, battery assembly 5. Liquid wicks from the liquid store 7 to the vaporiser 6. The battery assembly 5 provides electrical power to the vaporiser 6 via mutual electrical contacts of the battery assembly 5 and the vaporiser 6. The vaporiser 6 vaporises the wicked liquid and the vapour passes out of the air outlet 4. The liquid may for example comprise a nicotine solution.

The battery assembly 5 comprises a battery assembly casing 8, a power cell 9, electrical contacts 10 and a control circuit 11.

The battery assembly casing 8 comprises a hollow cylinder which is open at a first end 12. For example, the battery assembly casing 8 may be plastic. The electrical contacts 10 are located at the first end 12 of the casing 8, and the power cell 9 and control circuit 11 are located within the hollow of the casing 8. The power cell 9 may for example be a Lithium Cell.

The control circuit 11 includes an air pressure sensor 13 and a controller 14 and is powered by the power cell 9. The controller 14 is configured to interface with the air pressure sensor 13 and to control provision of electrical power from the power cell 9 to the vaporiser 6.

The vaporiser 6 comprises a vaporiser casing 15, electrical contacts 16, a heating element 17, a wicking element 18, a vaporisation cavity 19 and a heating element support 20.

The vaporiser casing 15 comprises a hollow cylinder which is open at both ends with an air inlet 21. For example, the vaporiser casing 15 may be formed of an aluminium alloy. The air inlet 21 comprises a hole in the vaporiser casing 15 at a first end 22 of the vaporiser casing 15. The electrical contacts 16 are located at the first end 22 of the vaporiser casing 15.

The first end 22 of the vaporiser casing 15 is releasably connected to the first end 12 of the battery assembly casing 8, such that the electrical contacts 16 of the vaporiser are electrically connected to the electrical contacts 10 of the battery assembly. For example, the device 1 may be configured such that the vaporiser casing 15 connects to the battery assembly casing 8 by a threaded connection.

Figure 4:
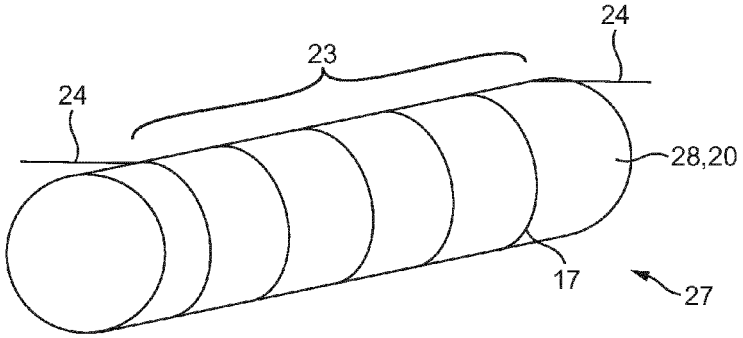
FIG. 4 is a side perspective view of a porous heating element support and a coil.
Figure 5:
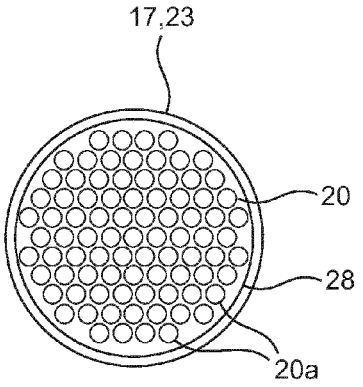
FIG. 5 is an end view of a porous heating element support and a coil.

The heating element 17 is formed of a single wire and comprises a heating element coil 23 and two leads 24, as is illustrated in FIGS. 4 and 5. For example, the heating element may be formed of Nichrome. The coil 23 comprises a section of the wire where the wire is formed into a helix about an axis A. At either end of the coil 23, the wire departs from its helical form to provide the leads 24. The leads 24 are connected to the electrical contacts 16 and are thereby configured to route electrical power, provided by the power cell 9, to the coil 23.

The wire of the coil 23 is approximately 0.12 mm in diameter. The coil is approximately 25 mm in length, has an internal diameter of approximately 1 mm and a helix pitch of approximately 420 micrometers. The void between the successive turns of the coil 23 is therefore approximately 300 micrometers.

The heating element 17 is located towards the second end 25 of the vaporiser casing 15 and is orientated such that the axis A of the coil 23 is perpendicular to the cylindrical axis B of the vaporiser casing 15. The coil 23 of the heating element 17 is thus perpendicular to the longitudinal axis C of the electronic cigarette 1.

The wicking element 18 extends from the vaporiser casing 15 into contact with the liquid store 7 of the mouthpiece 2. The wicking element 18 is configured to wick liquid in the direction W from the liquid store 7 of the mouthpiece 2 to the heating element 17. In more detail, the wick 18 comprises an arc of porous material extending from a first end of the coil 23, out past the second end 25 of the vaporiser casing 14 and back to a second end of the coil. For example, the porous material may be nickel foam, wherein the porosity of the foam is such that the described wicking occurs.

The vaporisation cavity 19 comprises a region within the hollow of the vaporiser casing 15 in which liquid is vaporised. The heating element 17, heating element support 20 and portions 26 of the wicking element 18 are situated within the vaporisation cavity 19.

Figure 3:
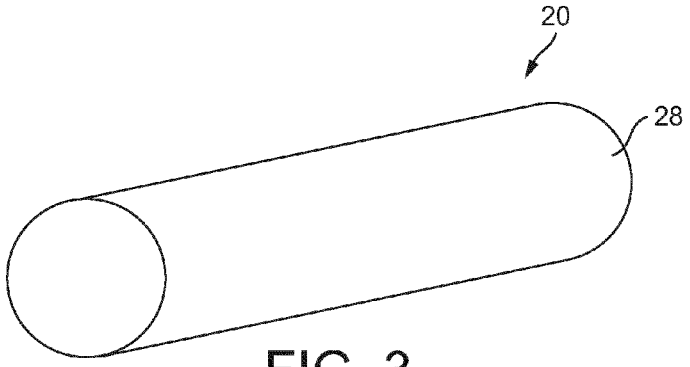
FIG. 3 is a side perspective view of a porous heating element support.

The heating element support 20 is configured to support the heating element 17 and to facilitate vaporisation of liquid by the heating element 17. The heating element support 20 is an inner support and is illustrated in FIGS. 3, 4 and 5. The support 20 comprises a rigid cylinder of porous ceramic material. For example, the porous ceramic material is shown to have pores 20*a* distributes throughout the material. The support 20 is situated coaxially within the helix of the heating element coil 23 and is slightly longer than the coil 23, such that the ends of the support 20 protrude from the ends of the coil 23. The diameter of the cylindrical support 20 is similar to the inner diameter of the helix. As a result, the wire of the coil 23 is substantially in contact with the support 20 and is thereby supported, facilitating maintenance of the shape of the coil 23. The heating element coil 23 is thus coiled, or wrapped, around the heating element support 20. The solidity provides a stable and secure structure to hold the coil 23 in place. The combination of the support 20 and the coil 23 of the heating element 17 provides a heating rod 27, as illustrated in FIGS. 4 and 5. The heating rod is later described in more detail with reference to FIGS. 4 and 5.

The surface 28 of the support 20 provides a route for liquid from the wick element 18 to wick onto and along, improving the provision of liquid to the vicinity of the heating element 17 for vaporisation. The surface 28 of the support 20 also provides surface area for exposing wicked liquid to the heat of the heating element 17. The porosity of the support allows liquid to be stored in the heating element support 20. The support is thus a further liquid store.

The mouthpiece 2 comprises a mouthpiece casing 29. The mouthpiece casing 29 comprises a hollow cylinder which is open at a first end 30, with the air outlet 4 comprising a hole in the second end 31 of the casing. For example, the mouthpiece casing may be formed of plastic.

The liquid store 7 is situated within the hollow of the mouthpiece casing 29. For example, the liquid store may comprise foam, wherein the foam is substantially saturated in the liquid intended for vaporisation. The cross-sectional area of the liquid store 7 is less than that of the hollow of the mouthpiece casing so as to form an air passageway 32 between the first end 30 of the mouthpiece casing 2 and the air outlet 4.

The first end 30 of the mouthpiece casing 29 is releasably connected to the second end 25 of the vaporiser casing 15, such that the liquid store 7 is in contact with a portion 33 of the wicking element 18 which protrudes from the vaporiser 6.

Liquid from the liquid store 7 is absorbed by the wicking element 18 and wicks along route W throughout the wicking element 18. Liquid then wicks from the wicking element 18 onto and along the coil 23 of the heating element 17, and onto and along the support 20.

There exists a continuous inner cavity 34 within the electronic cigarette 1 formed by the adjacent hollow interiors' of the mouthpiece casing 29, the vaporiser casing 15 and the battery assembly casing 8.

In use, a user sucks on the second end 31 of the mouthpiece 2. This causes a drop in the air pressure throughout the inner cavity 34 of the electronic cigarette 1, particularly at the air outlet 4.

The pressure drop within the inner cavity 34 is detected by the pressure sensor 13. In response to detection of the pressure drop by the pressure sensor, the controller 14 triggers the provision of power from the power cell 9 to the heating element 17 via the electrical contacts 10, 16. The coil of the heating element 17 therefore heats up. Once the coil 17 heats up, liquid in the vaporisation cavity 19 is vaporised. In more detail, liquid on the heating element 17 is vaporised, liquid on the heating element support 20 is vaporised and liquid in portions 26 of the wicking element 18 which are in the immediate vicinity of the heating element 17 may be vaporised.

The pressure drop within the inner cavity 34 also causes air from outside of the electronic cigarette 1 to be drawn, along route F, through the inner cavity from the air inlet 21 to the air outlet 4. As air is drawn along route F, it passes through the vaporisation cavity 19 and the air passageway 32. The vaporised liquid is therefore conveyed by the air movement along the air passageway 32 and out of the air outlet 4 to be inhaled by the user. In passing through the vaporisation cavity, along route F, the air moves over the heating element 17 in a direction substantially perpendicular to the axis A of the coil 23.

As the air containing the vaporised liquid is conveyed to the air outlet 4, some of the vapour may condense, producing a fine suspension of liquid droplets in the airflow. Moreover, movement of air through the vaporiser 6 as the user sucks on the mouthpiece 2 can lift fine droplets of liquid off of the wicking element 18, the heating element 17 and/or the heating element support 20. The air passing out of the outlet may therefore comprise an aerosol of fine liquid droplets as well as vaporised liquid.

The pressure drop within the vaporisation cavity 19 also encourages further wicking of liquid from the liquid store 7, along the wicking element 18, to the vaporisation cavity 19.

Figure 6:
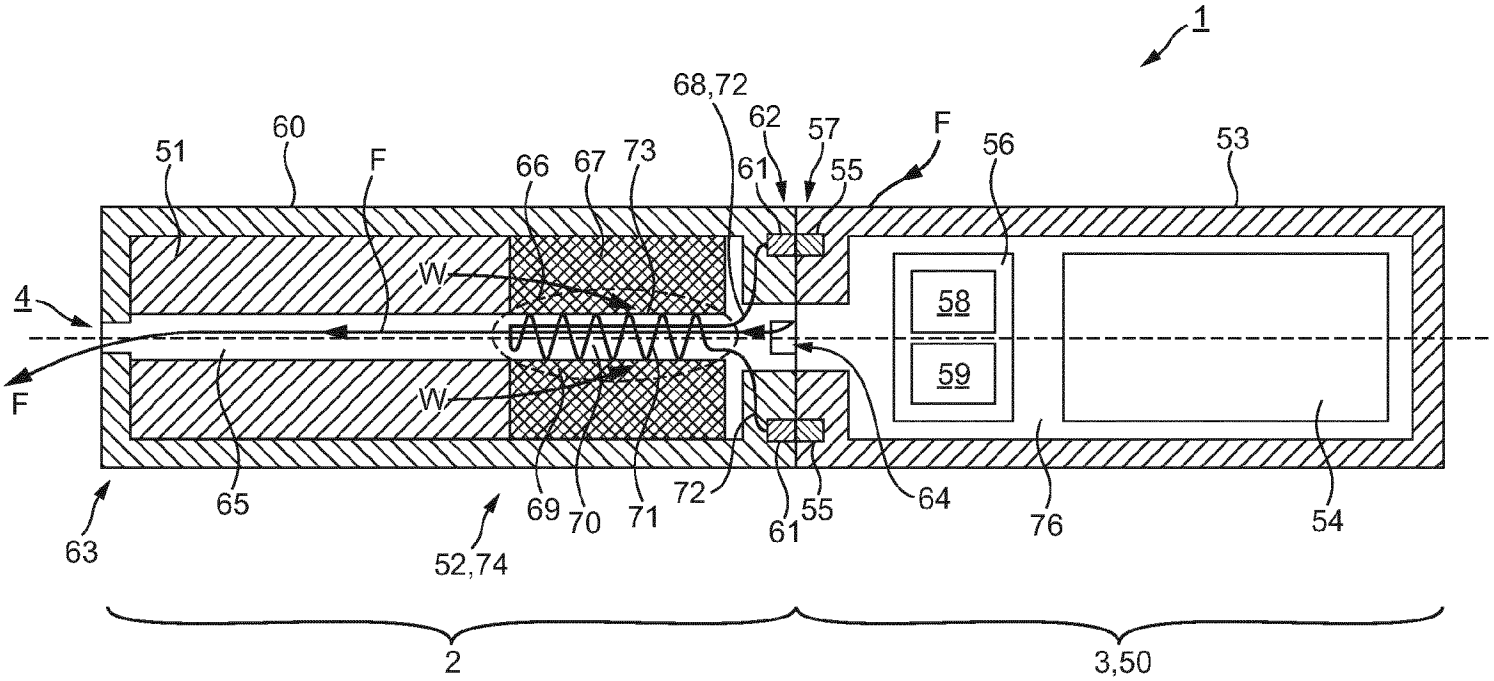
FIG. 6 is a schematic sectional view of an electronic cigarette having a parallel coil.

FIG. 6 shows a further example of the electronic cigarette 1 of FIG. 1. The body 3 is referred to herein as a battery assembly 50, and the mouthpiece 2 includes a liquid store 51 and a vaporiser 52. The electronic cigarette 1 is shown in its assembled state, wherein the detachable parts 2, 3 are connected. Liquid wicks from the liquid store 51 to the vaporiser 52. The battery assembly 50 provides electrical power to the vaporiser 52 via mutual electrical contacts of the battery assembly 50 and the mouthpiece 2. The vaporiser 52 vaporises the wicked liquid and the vapour passes out of the air outlet 4. The liquid may for example comprise a nicotine solution.

The battery assembly 50 comprises a battery assembly casing 53, a power cell 54, electrical contacts 55 and a control circuit 56.

The battery assembly casing 53 comprises a hollow cylinder which is open at a first end 57. For example, the battery assembly casing 53 may be plastic. The electrical contacts 55 are located at the first end 57 of the casing 53, and the power cell 54 and control circuit 56 are located within the hollow of the casing 53. The power cell 54 may for example be a Lithium Cell.

The control circuit 56 includes an air pressure sensor 58 and a controller 59 and is powered by the power cell 54. The controller 59 is configured to interface with the air pressure sensor 58 and to control provision of electrical power from the power cell 54 to the vaporiser 52, via the electrical contacts 55.

The mouthpiece 2 further includes a mouthpiece casing 60 and electrical contacts 61. The mouthpiece casing 60 comprises a hollow cylinder which is open at a first end 62, with the air outlet 4 comprising a hole in the second end 63 of the casing 60. The mouthpiece casing 60 also comprises an air inlet 64, comprising a hole near the first end 62 of the casing 60. For example, the mouthpiece casing may be formed of aluminium.

The electrical contacts 61 are located at the first end of the casing 60. Moreover, the first end 62 of the mouthpiece casing 60 is releasably connected to the first end 57 of the battery assembly casing 53, such that the electrical contacts 61 of the mouthpiece 2 are electrically connected to the electrical contacts 55 of the battery assembly 50. For example, the device 1 may be configured such that the mouthpiece casing 60 connects to the battery assembly casing 53 by a threaded connection.

The liquid store 51 is situated within the hollow mouthpiece casing 60 towards the second end 63 of the casing 60. The liquid store 51 comprises a cylindrical tube of porous material saturated in liquid. The outer circumference of the liquid store 51 matches the inner circumference of the mouthpiece casing 60. The hollow of the liquid store 51 provides an air passageway 65. For example, the porous material of the liquid store 51 may comprise foam, wherein the foam is substantially saturated in the liquid intended for vaporisation.

The vaporiser 52 comprises a vaporisation cavity 66, a heating element support 67 and a heating element 68.

The vaporisation cavity 66 comprises a region within the hollow of the mouthpiece casing 60 in which liquid is vaporised. The heating element 68 and a portion 69 of the support 67 are situated within the vaporisation cavity 66.

Figure 7:
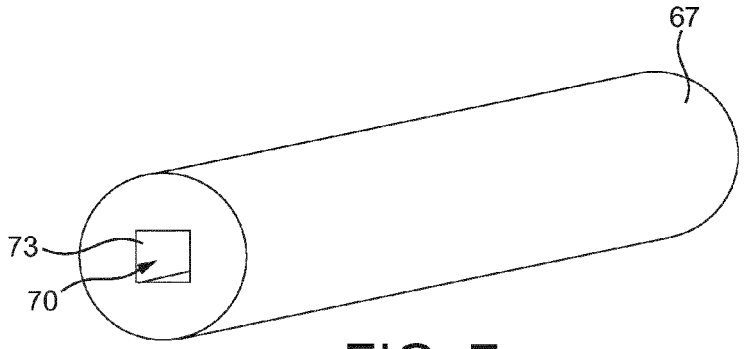
FIG. 7 is a side perspective view of an outer porous heating element support.
Figure 8:
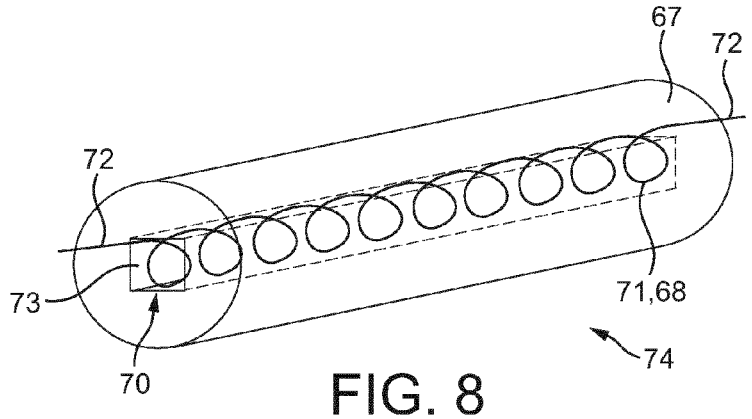
FIG. 8 is a side perspective view of an outer porous heating element support and a coil.
Figure 9:
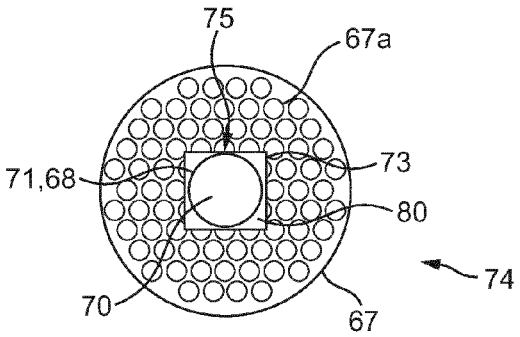
FIG. 9 is an end view of an outer porous heating element support and a coil.

The heating element support 67 is configured to support the heating element 68 from the outside and to facilitate vaporisation of liquid by the heating element 68 and is illustrated in FIGS. 7 to 9. Because the support 67 is located outside of the heating element 68, its size is not restricted by the size of the heating element, and so can be much larger than those of the embodiments described above. This facilitates the storing of more liquid by the porous heating element support 67 than those of the embodiments described above. The support 67 comprises a hollow cylinder of rigid, porous material and is situated within the mouthpiece casing 60, towards the first end 62 of the casing 60, such that it abuts the liquid store 51. The porous material has pores 67*a* distributes throughout. The outer circumference of the support 67 matches the inner circumference of the mouthpiece casing 60. The hollow of the support comprises a longitudinal, central channel 70 through the length of the support 67. The channel 70 has a square cross-sectional shape, the cross-section being perpendicular to the longitudinal axis of the support.

The support 67 acts as a wicking element, as it is configured to wick liquid in the direction W from the liquid store 51 of the mouthpiece 2 to the heating element 68. For example, the porous material of the support 67 may be nickel foam, wherein the porosity of the foam is such that the described wicking occurs. Once liquid wicks W from the liquid store 51 to the support 67, it is stored in the porous material of the support 67. Thus, the support 67 is an extension of the liquid store 51.

The heating element 68 is formed of a single wire and comprises a heating element coil 71 and two leads 72, as is illustrated in FIGS. 8 and 9. For example, the heating element 68 may be formed of Nichrome. The coil 71 comprises a section of the wire where the wire is formed into a helix about an axis A. At either end of the coil 71, the wire departs from its helical form to provide the leads 72. The leads 72 are connected to the electrical contacts 61 and are thereby configured to route electrical power, provided by the power cell 54, to the coil 71.

The wire of the coil 71 is approximately 0.12 mm in diameter. The coil is approximately 25 mm in length, has an internal diameter of approximately 1 mm and a helix pitch of approximately 420 micrometers. The void between the successive turns of the coil 71 is therefore approximately 300 micrometers.

The coil 71 of the heating element 68 is located coaxially within the channel 70 of the support. The heating element coil 71 is thus coiled within the channel 70 of the heating element support 67. Moreover, the axis A of the coil 71 is thus parallel to the cylindrical axis B of the mouthpiece casing 60 and the longitudinal axis C of the electronic cigarette 1.

The coil 71 is the same length as the support 67, such that the ends of the coil 71 are flush with the ends of the support 67. The outer diameter of the helix of the coil 71 is similar to the cross-sectional width of the channel 70. As a result, the wire of the coil 71 is in contact with the surface 73 of the channel 70 and is thereby supported, facilitating maintenance of the shape of the coil 71. Each turn of the coil is in contact with the surface 73 of the channel 70 at a contact point 75 on each of the four walls 73 of the channel 70. The combination of the coil 71 and the support 67 provides a heating rod 74, as illustrated in FIGS. 8 and 9. The heating rod 74 is later described in more detail with reference to FIGS. 8 and 9.

The inner surface 73 of the support 67 provides a surface for liquid to wick onto the coil 71 at the points 75 of contact between the coil 71 and the channel 70 walls 73. The inner surface 73 of the support 67 also provides surface area for exposing wicked liquid to the heat of the heating element 68.

There exists a continuous inner cavity 76 within the electronic cigarette 1 formed by the adjacent hollow interiors' of the mouthpiece casing 60 and the battery assembly casing 53.

In use, a user sucks on the second end 63 of the mouthpiece casing 60. This causes a drop in the air pressure throughout the inner cavity 76 of the electronic cigarette 1, particularly at the air outlet 4.

The pressure drop within the inner cavity 76 is detected by the pressure sensor 58. In response to detection of the pressure drop by the pressure sensor 58, the controller 59 triggers the provision of power from the power cell 54 to the heating element 68 via the electrical contacts 55, 26. The coil of the heating element 68 therefore heats up. Once the coil 17 heats up, liquid in the vaporisation cavity 66 is vaporised. In more detail, liquid on the coil 71 is vaporised, liquid on the inner surface 73 of the heating element support 67 is vaporised and liquid in the portions 22 of the support 67 which are in the immediate vicinity of the heating element 68 may be vaporised.

The pressure drop within the inner cavity 76 also causes air from outside of the electronic cigarette 1 to be drawn, along route F, through the inner cavity from the air inlet 64 to the air outlet 4. As air is drawn along route F, it passes through the vaporisation cavity 66, picking up vaporised liquid, and the air passageway 65. The vaporised liquid is therefore conveyed along the air passageway 65 and out of the air outlet 4 to be inhaled by the user. In passing through the vaporisation cavity, along route F, the air moves over the heating element 68 in a direction substantially parallel to the axis A of the coil 71.

As the air containing the vaporised liquid is conveyed to the air outlet 4, some of the vapour may condense, producing a fine suspension of liquid droplets in the airflow. Moreover, movement of air through the vaporiser 52 as the user sucks on the mouthpiece 2 can lift fine droplets of liquid off of the heating element 68 and/or the heating element support 67. The air passing out of the air outlet 4 may therefore comprise an aerosol of fine liquid droplets as well as vaporised liquid.

With reference to FIGS. 8 and 9, due to the cross-sectional shape of the channel, gaps 80 are formed between the inner surface 73 of the heating element support 67 and the coil 71. In more detail, where the wire of the coil 71 passes between contact points 75, a gap 80 is provided between the wire and the area of the inner surface 73 closest to the wire due to the wire substantially maintaining its helical form. The distance between the wire and the surface 73 at each gap 80 is in the range of 10 micrometers to 500 micrometers. The gaps 80 are configured to facilitate the wicking of liquid onto the coil 71 through capillary action at the gaps 80. The gaps 80 also provide areas in which liquid can gather prior to vaporisation, and thereby provide areas for liquid to be stored prior to vaporisation. The gaps 80 also expose more of the coil 71 for increased vaporisation in these areas.

Many alternatives and variations to the embodiments described above are possible. For example, alternatives and variations to the embodiments of FIGS. 2 to 5 are as follows.

Figure 10:
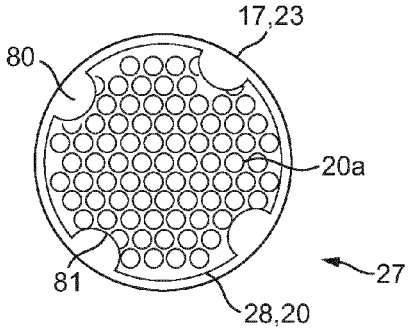
FIG. 10 is an end view of a porous heating element support with channels, and a coil.
Figure 11:
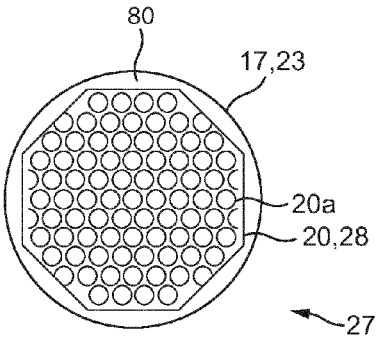
FIG. 11 is an end view of a porous heating element support having an octagonal cross-sectional shape, and a coil.
Figure 12:
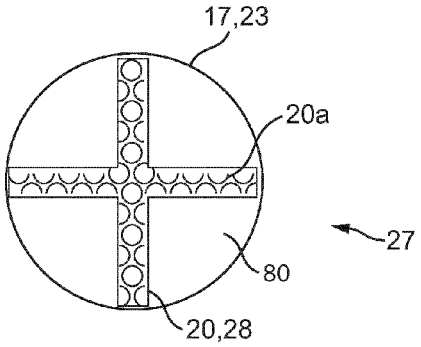
FIG. 12 is an end view of a porous heating element support having a four arm cross cross-sectional shape, and a coil.

FIGS. 10 to 12 show other examples of porous heating element supports 20 with a coil 23 wound around. These differ from the example shown in FIGS. 2 to 5 and from each other by the shape of the heating element support 20. In each of the examples of FIGS. 10 to 12, gaps 80 are provided between the heating element 17 and the support 20 by virtue of the cross-sectional shape of the support. In more detail, where the wire of the coil 23 passes over a depression in the surface 28, a gap 80 is provided between the wire and the area of the surface 28 immediately under the wire due to the wire substantially maintaining its helical form. The gaps 80 are therefore disposed in a radial direction from the axis A of the coil, between the surface 28 of the support 20 and the wire of the coil 23. The distance between the wire and the surface 28 at each gap 80 is in the range of 10 micrometers to 500 micrometers. The gaps 80 are configured to facilitate the wicking of liquid onto and along the length of the support 20 through capillary action at the gaps 80. As with the heating rods of FIGS. 8 and 9, the gaps 80 also facilitate the wicking of liquid onto the heating element 17 from the porous support 20 through capillary action at the gaps 80. The gaps 80 also provide areas in which liquid can gather on the surface 28 of the support 20 prior to vaporisation, and thereby provide areas for liquid to be stored prior to vaporisation. The gaps 80 also expose more of the coil 23 for increased vaporisation in these areas.

FIG. 10 shows a heating element support 20 having a generally cylindrical shape but having four surface channels 81 running lengthwise and spaced equally around the support 20. The coil 23 is wound around the support 20 and gaps 80 are provided where the coil turns overlap the channels 81. In more detail, where the wire of the coil 23 passes over a channel 81, a gap 80 is provided between the wire and the area of the surface 28 immediately under the wire.

The heating element support 20 is porous and stores liquid. The gaps 80 provided by the channels 81 have two functions. Firstly, they provide a means for liquid to be wicked both onto the coil 23 and into the heating element support 20 by capillary action. Secondly, they expose the coil 23 surface in the area of the channels 81 thereby increasing the vaporisation surface of the coil 23.

In FIG. 11, the heating element support 20 has an octagonal outer cross-sectional shape, perpendicular to the lengthwise direction. The coil 23 is wound around this support. Because the coil 23 is wire of some rigidity, the wire form does not match the exact outer form of the support, but tends to be curved. Thus, gaps 80 provided between the outer octagonal surface of the heating element support 20 and the curved coil 23.

Again, the heating element support 20 is porous for liquid storage and the gaps 80 provide a means of wicking liquid onto the coil 23, and expose a greater surface of the Coil 23 for increased vaporisation.

In FIG. 12, the heating element support 20 has an outer cross-sectional shape equal to a four arm cross. The coil 23 is wound around the support 20 and gaps 80 are provided between respective arms and the coil 23 surface. These gaps 80 provide the same advantages already described.

Moreover, where channels 81 are provided in the heating element support 20, a number other than one or four channels 81 can be used.

Furthermore, channels 81 have been described as longitudinal grooves along the surface 28 of cylindrical supports 20. However, the channels 81 may, for example, alternatively or additionally comprise helical grooves in the surface 28 of a cylindrical support 20, spiraling about the axis of the support. Alternatively or additionally the channels 81 may comprise circumferential rings around the surface 28 of the support 20.

In embodiments, the inner support 20 is described as being slightly longer than the coil 23, such that it protrudes from either end of the coil 23. Alternatively, the support 20 may be shorter in length than the coil 23 and may therefore reside entirely within the bounds of the coil.

Figure 13:
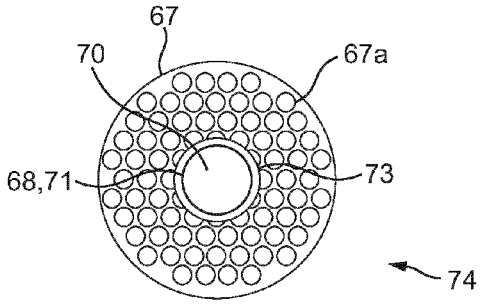
FIG. 13 is an end view of an outer porous heating element support and a coil.
Figure 14:
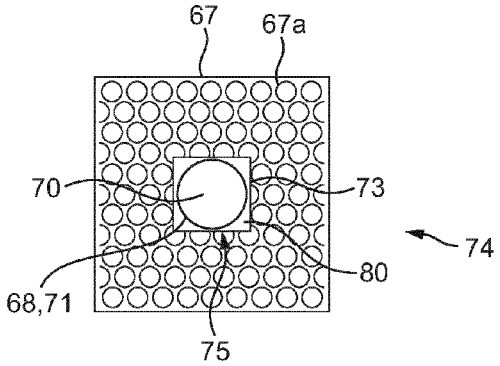
FIG. 14 is an end view of an outer porous heating element support and a coil.
Figure 15:
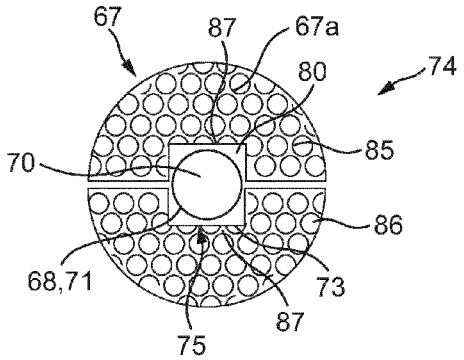
FIG. 15 is an end view of an two part outer porous heating element support and a coil.

Furthermore, example alternatives and variations to the embodiments of FIGS. 6 to 9 are as follows. FIGS. 13 to 15 show other examples of outer porous heating element supports 67 with an internal coil 71. These differ from the example shown in FIGS. 7 and 9 and from each other by the shape of the heating element support 67.

FIG. 13 shows a device similar to that shown in FIG. 9 with the exception that the internal channel 70 has a circular cross-sectional shape rather than a square. This provides an arrangement where a coil 71 is fitted into the internal channel 70 and is in contact with the channel 70 surface along the length of the channel 70 substantially without gaps in the contact areas. This extra contact provides an increased means for liquid to be wicked onto the coil 71 and a general decrease in the vaporisation area of the coil 71.

In FIG. 14 a device is shown similar to that shown in FIG. 9. In this example, the outer cross-sectional shape of the heating element support 67 is a square rather than a circle.

FIG. 15 shows a heating element support 67 comprising a first support section 85 and a second support section 86. The heating element support 67 is generally cylindrical in shape and the first support section 85 and second support section 86 are half cylinders with generally semi-circular cross-sections, which are joined together to form the cylindrical shape of the heating element support 67.

The first support section 85 and second support section 86 each have a side channel 87, or groove 87, running along their respective lengths, along the middle of their otherwise flat longitudinal surfaces. When the first support section 85 is joined to the second support section 86 to form the heating element support 67, their respective side channels 87 together form the heating elements support 67 internal channel 70.

In this example, the combined side channels 87 form an internal channel 70 having a square cross-sectional shape. Thus, the side channels 87 are each rectangular in cross-section. The coil 71 is situated within the heating element support 67 internal channel 70. Having a heating element support 67 that comprises two separate parts 85, 86 facilitates manufacture of this component. During manufacturing, the coil 71 can be fitted into the side channel 87 of the first support section 85, and the second support section 86 can be placed on top to form the completed heating element support 67.

Internal support channels 70 with cross-sectional shapes other than those described could be used.

Moreover, the coil 71 may be shorter in length than the outer support 67 and may therefore reside entirely within the bounds of the support. Alternatively, the coil 71 may be longer than the outer support 67.

In embodiments, the support 67 may be located partially or entirely within liquid store 51. For example, the support 67 may be located coaxially within the tube of the liquid store 51.

Furthermore, example alternatives and variations to the embodiments described above are as follows.

An electronic vapour provision device comprising an electronic cigarette 1 is described herein. However, other types of electronic vapour provision device are possible.

The wire of the coil 23, 71 is described above as being approximately 0.12 mm thick. However, other wire diameters are possible. For example, the diameter of the coil wire may be in the range of 0.05 mm to 0.2 mm. Moreover, the coil 23, 71 length may be different to that described above. For example, the coil 23, 71 length may be in the range of 20 mm to 40 mm.

The internal diameter of the coil 23, 71 may be different to that described above. For example, the internal diameter of the coil 23, 71 may be in the range of 0.5 mm to 2 mm.

The pitch of the helical coil 23, 71 may be different to that described above. For example, the pitch may be between 120 micrometers and 600 micrometers.

Furthermore, although the distance of the voids between turns of the coil 23, 71 is described above as being approximately 300, different void distances are possible. For example, the void may be between 20 micrometers and 500 micrometers.

The size of the gaps 80 may be different to that described above.

Furthermore, the electronic vapour provision device 1 is not restricted to the sequence of components described and other sequences could be used such as the control circuit 11, 56 being in the tip of the device or the liquid store 7, 51 being in the electronic vapour provision device 1 body 3 rather than the mouthpiece 2.

The electronic vapour provision device 1 of FIG. 2 is described as comprising three detachable parts, the mouthpiece 2, the vaporiser 6 and the battery assembly 5. Alternatively, the electronic vapour provision device 1 may be configured such these parts 2, 6, 5 are combined into a single integrated unit. In other words, the mouthpiece 2, the vaporiser 6 and the battery assembly 5 may not be detachable. As a further alternative, the mouthpiece 2 and the vaporiser 6 may comprise a single integrated unit, or the vaporiser 6 and the battery assembly 5 may comprise a single integrated unit.

The electronic vapour provision device 1 of FIG. 6 is described as comprising two detachable parts, the mouthpiece 2 and the body comprising the battery assembly 50. Alternatively, the device 1 may be configured such these parts 2, 50 are combined into a single integrated unit. In other words, the mouthpiece 2 and the body 3 may not be detachable.

The heating element 17, 68 is not restricted to being a coil 23, 71, and may be another wire form such as a zig-zag shape.

An air pressure sensor 13, 58 is described herein. In embodiments, an airflow sensor may be used to detect that a user is sucking on the device.

The heating element 17, 68 is not restricted to being a uniform coil.

The porous material of the heating element support 20, 67 may be optimised for retention and wicking of certain liquids. For example the porous material may be optimised for the retention and wicking of a nicotine solution. For instance, the nicotine solution may be liquid containing nicotine diluted in a propylene glycol solution.

The heating element support 20, 67 is not limited to being a porous ceramic and other solid porous materials could be used such as porous plastics materials or solid foams.

Reference herein to a vaporisation cavity 19, 66 may be replaced by reference to a vaporisation region.

Although examples have been shown and described it will be appreciated by those skilled in the art that various changes and modifications might be made without departing from the scope of the invention.

In order to address various issues and advance the art, the entirety of this disclosure shows by way of illustration various embodiments in which the claimed invention(s) may be practiced and provide for superior electronic vapour provision. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future. Any feature of any embodiment can be used independently of, or in combination with, any other feature.

The invention claimed is:

1. An electronic vapor provision device comprising a power cell, a vaporizer and a liquid store, the vaporizer including a heater and a cylindrical heater support of porous ceramic material configured to support the heater without a separate support for the heater, the heater being internally supported from its inside by the heater support, and the heater and the heater support arranged so that a longitudinal axis of the heater is perpendicular to a direction of air movement over the heater, the liquid store comprising a porous material, and the heater support being, or forming part of, the liquid store, the device further comprising a mouthpiece section, and the vaporizer being part of the mouthpiece.

2. The electronic vapor provision device of claim 1, wherein the electronic vapor provision device is an electronic cigarette.

3. The electronic vapor provision device of claim 1, wherein the porous material is rigid porous material.

4. The electronic vapor provision device of claim 1, wherein the porous material is a porous ceramic material.

5. The electronic vapor provision device of claim 1, wherein the porous material is configured for liquid retention and wicking.

6. The electronic vapor provision device of claim 1, wherein the porous material comprises pores of substantially equal size.

7. The electronic vapor provision device of claim 1, wherein the porous material comprises pores distributed substantially evenly throughout the porous material.

8. The electronic vapor provision device of claim 1, wherein the porous material is configured such that a majority of a volume of the porous material comprises open pores configured for liquid storage.

9. The electronic vapor provision device of claim 1, wherein the liquid store is sealed on at least part of an outer surface region, thereby inhibiting a porosity of that region.

10. The electronic vapor provision device of claim 1, wherein the porous material comprises smaller pores in a region substantially adjacent to the heater, and larger pores in a region further from the heater.

11. The electronic vapor provision device of claim 1, wherein the porous material comprises a gradient of pore sizes ranging from smaller pores proximal to the heater to larger pores distal to the heater.

12. The electronic vapor provision device of claim 1, wherein the liquid store is configured, in use, to wick liquid onto the heater.

13. The electronic vapor provision device of claim 1, wherein one or more gaps are defined between the heater and the heater support.

14. The electronic vapor provision device of claim 1, wherein the heater is a heating coil.

15. The electronic vapor provision device of claim 14, wherein the heating coil is a wire coil.

16. The electronic vapor provision device of claim 14, wherein the heating coil is coiled so as to be supported along its length by the heater support.

17. The electronic vapor provision device of claim 14, wherein turns of the heating coil are in contact with the heater support and are thereby supported by the heater support.

18. The electronic vapor provision device claim 14, wherein one or more gaps are defined between the heating coil and the heater support.

19. The electronic vapor provision device of claim 18, wherein the one or more gaps are between the coil turns and the heater support.

20. The electronic vapor provision device of claim 1, wherein the vaporizer defines a vaporization cavity such that, in use, the vaporization cavity is a negative pressure cavity.

21. The electronic vapor provision device of claim 20, wherein at least part of the heater is inside the vaporization cavity.

22. The electronic vapor provision device of claim 1, wherein the liquid store forms part of the mouthpiece section.

23. The electronic vapor provision device of claim 22, wherein the liquid store substantially fills the mouthpiece section.

24. The electronic vapor provision device of claim 1, further comprising an outlet for vaporized liquid from the heater.

25. A mouthpiece section for an electronic vapor provision device having a power cell, the mouthpiece section comprising:

a vaporizer including a heater and a cylindrical heater support of porous ceramic material configured to support the heater without a separate support for the heater, the heater being internally supported from its inside by the heater support, and the heater and the heater support arranged so that a longitudinal axis of the heater is perpendicular to a direction of air movement over the heater; and a liquid store comprising a porous material, the heater support being at least part of the liquid store.

* * * * *